United States Patent [19]

Bailey et al.

[11] 4,025,292

[45] May 24, 1977

[54] HIGH PRESSURE BURNER WITH INTEGRAL PILOT

[76] Inventors: A. Preston Bailey, Box 386, Santa Anna, Tex. 76878; Lawrence J. Sullivan, 2688 E. 25th St., Odessa, Tex. 79761

[22] Filed: Dec. 15, 1975

[21] Appl. No.: 640,589

[52] U.S. Cl. ..... 431/353; 431/354

[51] Int. Cl.[2] ..... F23D 15/02

[58] Field of Search ..... 431/353, 350, 351, 354

[56] References Cited

UNITED STATES PATENTS

| | | | |
|---|---|---|---|
| 2,952,307 | 9/1960 | Schramm et al. | 431/349 X |
| 3,750,642 | 8/1973 | Machlanski | 431/353 X |
| 3,802,829 | 4/1974 | Morris | 431/353 |
| 3,861,858 | 1/1975 | Hemsath et al. | 431/353 |

*Primary Examiner*—Edgar W. Geoghegan
*Attorney, Agent, or Firm*—Marcus L. Bates

[57] ABSTRACT

A high pressure burner has an integral pilot and is employed in conjunction with a direct fired heater. The burner produces a long flame within the heating tube of the exchanger and therefore more efficiently transfers the heat of combustion into the medium being heated.

The burner comprises an elongated mixing barrel attached to a control block. The main fuel gas along with the pilot gas enters the interior of the block and flows therethrough and through an orifice where the gas admixes with air in an unusual manner, and the mixture continues through the mixing barrel. Combustion of the gaseous mixture occurs downstream of the barrel.

When the main fuel supply is turned off, the pilot gas supply flows through the burner assembly and forms a standing flame at the end thereof; and when the main fuel supply is opened, an elongated flame is established which extends a long way down the fire tube, thereby heating a large surface area of the fire tube, thus avoiding undue heating of any isolated area.

12 Claims, 6 Drawing Figures

HIGH PRESSURE BURNER WITH INTEGRAL PILOT

| RELATED ART | | |
|---|---|---|
| Schramm et al | 2,952,307 | 431/349×r |
| Machlanski | 3,750,642 | 431/353×r |
| Hemsath et al | 3,861,858 | 431/353 |
| Morris | 3,802,829 | 431/353 |

BACKGROUND OF THE INVENTION

In the oil production industry, there are numerous instances where an inexpensive and reliable source of heat is required in order to carry out profitable production. It is customary for the various sizes and configurations of vessels used in production of oil to be heated in the most simple and economical manner possible, because they must have the capability of efficiently operating over a projected period of time without any attention. The heat transfer apparatus often includes a direct fired tubular type conduit which is enclosed within a vessel in such a manner that the interior of the tube can be directly fired by the combustion products provided by a gas burner. There is usually ample raw gaseous hydrocarbons available in the oil patch for use as fuel.

It is therefore desirable to have made available a rugged, efficient burner device which can directly fire a heat exchanger, and which can be easily controlled so that the temperature of the vessel is maintained at any reasonable predetermined value. It is necessary that the burner have a reliable pilot light associated therewith so that ignition always occurs during initiation of the heating cycle. It is further desirable that the burner be efficient in operation, low in cost, rugged in design, and reliable in operation.

SUMMARY OF THE INVENTION

This invention comprehends a high pressure gas burner in combination with a direct fired heat exchanger. The burner includes an elongated mixing barrel connected to a hollow block assembly, with a valve stem being received through the block in aligned relationship respective to an orifice of the burner so that flow of gas therethrough can be controlled.

The burner includes a source of pilot gas and main burner gas which preferably is connected by individual flow lines into the interior of the block in such a manner that both the pilot gas and main burner gas must flow into the burner block and through the orifice where the gas admixes with air within the barrel. The components of the burner are sized to cause combustion to occur downstream of the barrel.

The burner is mounted to a direct fired heat exchange tube having an air supply connected thereto so that a source of air is available for the interior of the barrel. Accordingly, the combustion process initiates at the end of the barrel and extends over a projected length of the direct fired tube, thereby preventing localized hot spots and enhancing the combustion process.

Accordingly, a primary object of this invention is the provision of a high pressure gas burner in combination with a direct fired heat exchanger tube.

Another object of the invention is to provide a gas burner and exchanger tube combination having a gas and air flow path which provides improvements in heat exchange apparatus.

A further object of this invention is to disclose and provide a gas burner having an integral pilot which produces a flame which extends from the outlet end of the burner to a location exceedingly spaced therefrom.

A still further object of this invention is the provision of a gas burner having a mixing barrel which admixes air and gas therewithin to provide combustion products which are subsequently further admixed with air downstream of the burner.

Another and still further object of the invention is to disclose and provide combustion equipment for heating a direct fired heat exchanger device wherein the pilot gas, main gas, and combustion air are efficiently combined in an unusual and heretofore unknown manner.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Throughout the present disclosure, wherever it is practical or logical to do so, like or similar numerals will refer to like or similar objects.

Figure 1:
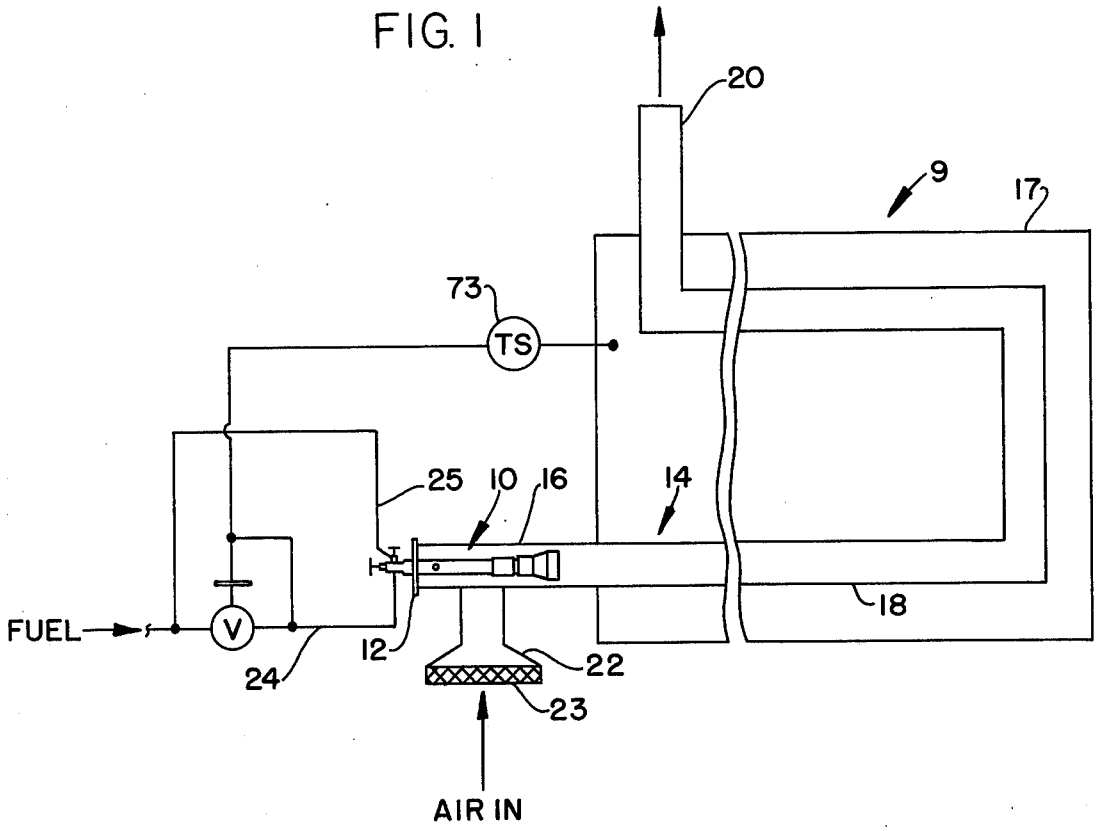
FIG. 1 is a part schematical, part diagrammatical representation of a heat exchanger apparatus having a burner associated therewith made in accordance with the present invention.

In FIG. 1 there is disclosed a heating system 9 made in accordance with this invention. The system has a burner 10 incorporated therewith which forms part of the present invention.

The burner is removably bolted to a flange 12 which is connected to a direct fired heat exchanger tube 14. The tube has an external marginal portion 16 located externally of a tank 17, and an internal submerged portion 18 disposed within the tank such that combustion gases flowing through the flue, or outlet 20, transmits heat into any fluid contained within the tank.

Air inlet 22 includes an external flame arrester 23 connected thereto so that air can safely flow into the marginal outside length 16 of the exchanger tube, thereby providing primary combustion air for the burner, as well as providing secondary air of combustion.

Gas inlet pipe 24 provides the burner with combustion gases, while a smaller conduit 25 provides the burner with a source of pilot gas. The illustrated motor valve is preferably interconnected between the main gas source and the pilot gas source, to enable temperature control to be effected upon the contents of the tank.

Figure 2:
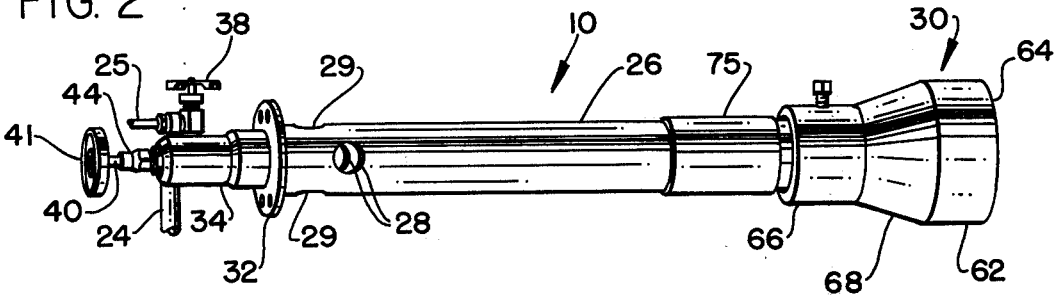
FIG. 2 is an enlarged, perspective, side view of a burner made in accordance with the present invention.

In FIG. 2 there is disclosed the before mentioned burner, made in accordance with the present invention. The burner includes a longitudinally extending barrel 26 of circular configuration. The barrel has a plurality of radially spaced apart air inlet ports 28 and 29 formed in a sidewall thereof. The outlet end of the burner preferably takes on the form of an adjustable bell 30 which is spaced from a mounting flange 32. The before mentioned air inlet ports are located between the flange and bell, in close proximity to the mounting flange, so that a source of air from inlet 22 is available to the ports.

Figure 3:
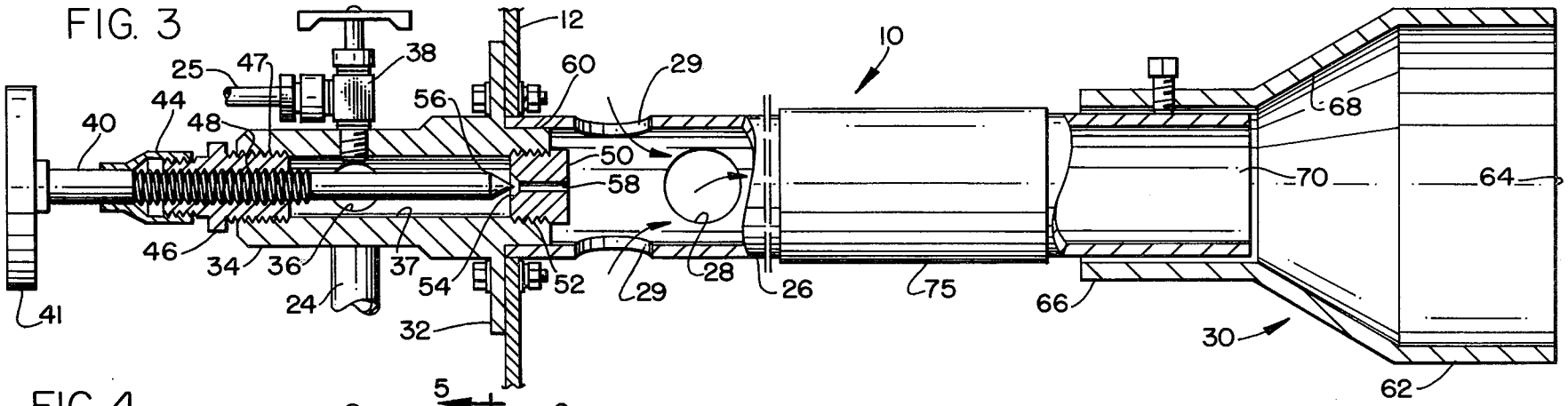
FIG. 3 is still a further enlarged, cross-sectional view of a burner made in accordance with the present invention.

As seen in FIG. 3, a burner block 34 is provided with a main gas inlet port 36. A pilot inlet port 25 is attached to the illustrated adjustable pilot valve 38. Valve stem 40 is removably mounted to the burner block in the illustrated manner of FIGS. 3 or 4. The relationship between the air inlet 22, the direct fired exchanger tube, and the remainder of the apparatus is hereinafter described in greater detail.

In the embodiment of FIG. 3, the valve stem is seen to be provided with an adjusting handle 41, while an adjustable compression nut 44 seals the stem to a packing gland 46. The packing gland includes both external and internal threads which enable the gland to threadedly engage a marginal interior 37 of the block, as well as the marginal threaded exterior surface 48 of the valve stem.

An orifice member 50 threadedly mates with the outer marginal end portion of the axial passageway 37, and includes a conical seat 54 which sealingly engages the reduced end 56 of the stem to thereby provide an adjustable orifice having an outlet at 58.

The flange 32 is made integral with the burner block. The outlet end of the burner block is reduced along its marginal end portion to form a close tolerance fit at 60 between the block and the marginal end of the barrel 26. The barrel and block are rigidly affixed to one another.

The bell 30 includes a large outwardly opening cylindrical skirt 62 having an outer terminal edge portion 64 which defines the outermost end of the burner assembly. The small diameter portion 66 of the bell outwardly diverges at 68 into the large diameter portion. The illustrated set screw enables the bell to be telescopingly moved along the outer marginal end portion of the barrel so that outlet 70 of the barrel can be adjustably moved respective to the outer edge portion 64 of the bell.

Figure 4:
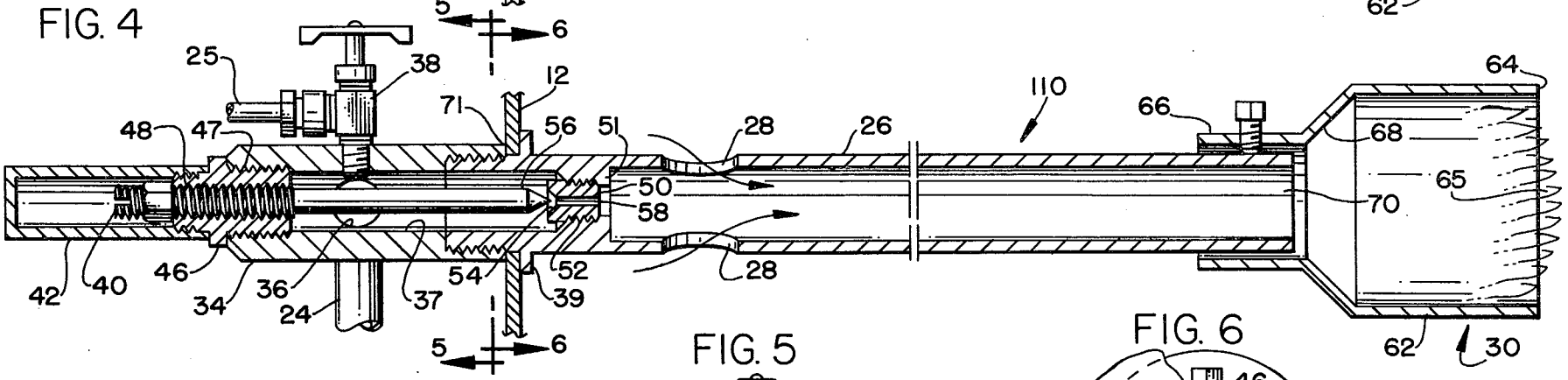
FIG. 4 is a longitudinal, cross-sectional view, similar to FIG. 3, of a burner made in accordance with the present invention; and, FIGS. 5 and 6, respectively, are cross-sectional views taken along lines 5—5 and 6—6, respectively, of FIG. 4.
Figure 6:
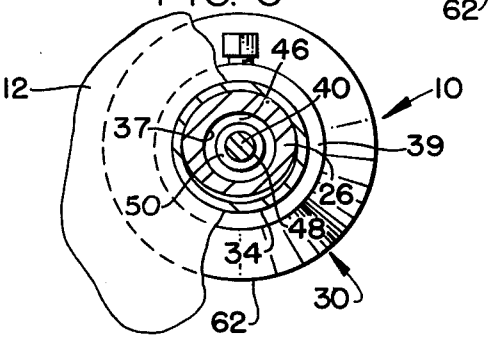
Figure 5:
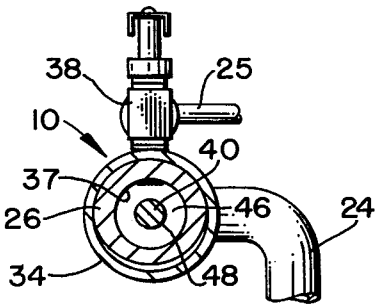

In the embodiment as seen illustrated in FIG. 4, the orifice member 50 threadedly engages an annular boss 51 so that the orifice member essentially becomes part of the barrel and is removed therewith when it is desired to disassemble the burner. The inlet end of the barrel is provided with a circumferentially extending flange 39 which is made integrally therewith and enables the burner to be directly mounted to the wall 12 by sandwiching the wall between a shoulder 71 of the block 34 and the mounting flange as the burner block is made up to the burner barrel. This expedient greatly facilitates mounting the burner within the apertured end wall 12 of the exchanger tube.

In operation, a gaseous hydrocarbon fuel supply is provided to the upstream side of the illustrated valve of FIG. 1, the pilot valve 38 is opened, and the valve stem unseated from its seat. Ignition is provided at a location adjacent to the outlet of the bell by using standard techniques known to those skilled in the art. The pilot valve is next adjusted to provide a standing flame such as seen illustrated by numeral 65 in FIG. 4. The motor valve ("V" in FIG. 1) is moved to the opened position causing an inflow of gas at 36. The gas flows into chamber 37 and then through the orifice member 50. This action moves the flame front 65 down the interior of the exchanger tube. Both the motor valve and the valve stem are adjusted until a long yellow flame is evidenced within a considerable length of the exchange tube. The temperature of the flue gases at outlet 20 is monitored, while the gas flow is measured to assure that the burner is delivering its rated BTU. After the motor valve and valve stem have each been adjusted relative to one another to provide a proper inflow of gas into the gas chamber 37 of the burner block, the apparatus is placed in standby configuration until a sensor 73 causes the motor valve to move to the opened position. The sensor and its cooperative relationship respective to the motor valve and burner are considered standard techniques.

The embodiment disclosed in FIG. 3 is the preferred embodiment for use in large BTU burners. For example, in one embodiment of the invention, the barrel is 20 inches long and has a $2\frac{7}{16}$ inches outside diameter. The major outside diameter of the bell is 5⅓ inches. The orifice member outlet at 58 has a ⅜ inch inside diameter, and the burner output is rated at 2.4 million BTU at 15 psig pressure when using gaseous hydrocarbons having a heat content of 1,000 BTU per cubic foot.

The embodiment of FIG. 4 is preferred for use in conjunction with small burner installations, as for example 0.3 million BTU input rating at 15 psig fuel pressure. The barrel length is 12 inches, the major bell diameter is $2\frac{7}{16}$ inches, and the inside diameter of the orifice member 50 is $\frac{7}{16}$ inch.

In the present invention, fuel flowing through the orifice member 50 induces air to enter ports 28. The air is preheated as it flows into the exchanger tube. As the gaseous hydrocarbons admix with the air and flow through the barrel, a considerable additional amount of preheating occurs. The gaseous products exit the bell where combustion commences. Combustion occurs at the bell outlet and continues downstream of the burner, preferably along a considerable length of the heater tube, thereby avoiding hot spots and furthermore preventing fouling of the external surfaces of the exchanger tube by maintaining a more uniform distribution of heat.

Accordingly, part of the combustion air enters ports 28 as the primary air supply, where the air admixes with the gaseous hydrocarbons in an amount which is sufficient to support combustion. A secondary part of the air entering at 22 becomes combustion air as it admixes with the partially burned hydrocarbons at a location downstream of the bell. The remaining air entering at 22 is not combusted and serves to further control the temperature of the flue gases. This expedient produces a long, slow burning flame which maintains the temperature of the exchanger tube at an optimum valve, while at the same time, efficiently converts the fuel into heat.

When the motor valve "V" closes and interrupts the main fuel supply to inlet 36, pilot gas continues to flow through the pilot valve 38, into the gas chamber of the block 34, through the valve seat of the nozzle, or orifice, and into the barrel. Accordingly, as the motor valve closes, the flame front located downstream within the exchanger tube 14 recedes and travels back up to the skirt 62. The pilot flame continues to burn at 65 until the motor valve again assumes the opened position.

The present invention provides a highly efficient burner which is externally adjusted for both the main and pilot flames. The pilot control and main burner control are integrally built within the burner assembly; and accordingly, there is no separate pilot mechanism which must be cleaned and maintained. Therefore, one of the major sources of burner malfunction is obviated.

The present burner operates satisfactorily on fuel pressures of 5–15 psig. By utilizing high pressure gaseous fuel, it is unnecessary to employ gas pressure reduction apparatus. Therefore, refrigeration type freezing associated with the supply gas regulators is never encountered.

The present burner barrel is made of tubular steel, and there is no need to employ cast iron components which are liable to break under extreme handling conditions. The burner valve orifice and stem are both readily replaceably in a simple and straightforward manner.

The arrangement of primary and secondary air is such that flow must occur through the flame arrestor; and therefore, there is no air intake required in front of the burner plate. The present invention can be sized to efficiently combust 0.3 to 4.8 million cubic feet of gas, thereby covering a wide range of application.

The above specific examples of the invention should not be construed as inviting limitations respective to the physical size of the burner components. For example, an orifice smaller than $\frac{7}{64}$ inch can be employed to advantage herein, should such an expedient be deemed desirable.

In operation, it has been found advantageous to adjust the air/fuel ratio of the pilot so that the resultant flame is representative of a reducing combustion process. This results in a more favorable state of combustion because undesirable air currents, such as are occasioned by gusty, windy conditions, will tend to push the air/fuel ratio of the flame towards the neutral or oxidizing state, thereby avoiding the likelihood of extinguishing the pilot flame.

I claim:

1. A high pressure burner for direct fired exchangers comprising an elongated mixing barrel having an inlet end and an outlet end, a block affixed to said barrel and having an axial passageway formed therethrough;

a valve stem axially aligned with said axial passageway of said block, an orifice member having a valve seat axially aligned with said barrel;

said valve stem being telescopingly received within said block and movable into seated relationship respective to said valve seat;

seal means which sealingly engage said block and said valve stem to prevent flow therebetween, means by which said seal means and said seat are spaced apart to provide a gas containing chamber therebetween;

means forming a primary gas inlet and a pilot gas inlet into said gas containing chamber, means forming an air inlet port into said barrel;

said primary gas inlet and said pilot gas inlet being flow connected to said gas containing chamber so that gas flowing into the chamber must flow through said seat when said valve stem is spaced therefrom;

said air inlet port being formed in said barrel at a location downstream of said orifice member and upstream of said outlet end so that air flowing into said barrel is admixed with gas flowing through said orifice member, thereby enabling combustion to occur at said outlet end of said barrel.

2. The burner of claim 1 wherein said outlet end of said barrel diverges into a bell, said bell having a major diameter which is at least twice the diameter of said barrel.

3. The burner of claim 1, and further including a mount means located between said air inlet and said gas inlet so that a gaseous fuel supply can be connected to the burner at a location which is isolated from the combustion products.

4. The burner of claim 1 wherein said orifice member is mounted within said burner barrel at a location upstream of said air inlet port;

said pilot gas inlet and main fuel inlet being connected to said block at a location spaced from said barrel;

said seal means being a packing gland which is removably affixed to said block so that said gland can be removed from said block along with said valve stem while said orifice member remains within said barrel.

5. The burner of claim 1 wherein said barrel has a threaded reduced diameter inlet end which leaves a circumferentially extending shoulder thereabout, said block having a threaded marginal end portion which threadedly engages said barrel, so that the burner can be mounted within a burner plate by sandwiching the plate between the block and the barrel.

6. The burner of claim 1, and further including a tank, a fire tube disposed within said tank for heating any fluid which may be contained therewithin; said fire tube having a flange at one end thereof; an air inlet formed into said tube at a location adjacent to said flange, means mounting said burner to said flange such that said block is located outside of said tube and said barrel is located within said tube;

a gas supply, a motor valve, a thermostat positioned to sense the temperature of any fluid contained within said tank; means by which said thermostat causes said motor valve to assume a closed position upon said thermostat sensing an elevated temperature; means by which said motor valve connects said gas supply to said primary gas inlet;

and valve means connecting said pilot gas inlet to said gas supply.

7. The burner of claim 6 wherein said barrel has a threaded reduced diameter inlet end which leaves a circumferentially extending shoulder thereabout, said block having a threaded marginal end portion which threadedly engages said barrel, so that the burner can be mounted within a burner plate by sandwiching the plate between the block and the barrel.

8. A direct fired heater apparatus having an exchanger tube, a bulkhead forming a closure member at one end of said tube;

an air inlet formed in said tube at a location adjacent to said bulkhead;

a burner having a mixing barrel, said barrel having an inlet end and an outlet end, a block affixed to said barrel and having an axial passageway formed therethrough, a valve stem axially aligned with said axial passageway, an orifice member having a valve seat axially aligned with said barrel, said valve stem being telescopingly received within said block and movable into seated relationship respective to said valve seat;

a packing gland sealingly engaging said block and said valve stem to prevent flow therebetween; said packing gland and said seat being spaced from one another to provide a gas containing chamber therebetween;

means forming a primary gas inlet, a pilot gas inlet, and an air inlet port;

said primary gas inlet and said pilot gas inlet being flow connected to said chamber so that gas flowing therefrom must flow through seat when said stem is lifted therefrom;

said air inlet port being formed in said barrel at a location downstream of said orifice member and upstream of said main outlet;

said air inlet into said exchanger tube being located adjacent to said burner so that air flowing into said tube is diverted along two flow paths;

one flow path being into said burner inlet port where the air admixes with the gas and flows through the outlet of said mixing barrel;

part of the remaining air flowing into said exchanger tube admixes with the partially combusted air so that combustion process is completed downstream of the outlet of the burner.

9. The apparatus of claim 8 wherein said outlet end of said barrel diverges into a bell, said bell having a major diameter which is at least twice the diameter of said barrel.

10. The apparatus of claim 8 wherein a mount means is located between said air inlet and said gas inlet so that a gaseous fuel supply can be connected to the burner at a location which is isolated from the combustion products.

11. The apparatus of claim 8 wherein said orifice member is mounted within said burner barrel at a location upstream of said air inlet port;

said pilot gas inlet and main fuel inlet being connected to said block at a location spaced from said barrel;

said seal means being a packing gland which is removably affixed to said block so that said gland can be removed from said block along with said valve stem while said orifice member remains within said barrel.

12. The apparatus of claim 8 wherein said barrel has a threaded reduced diameter inlet end which leaves a circumferentially extending shoulder thereabout, said block having a threaded marginal end portion which threadedly engages said barrel, so that the burner can be mounted within a burner plate by sandwiching the plate between the block and the barrel.

* * * * *

UNITED STATES PATENT OFFICE

CERTIFICATE OF CORRECTION

PATENT NO. : 4,025,292

DATED : May 24, 1977

INVENTOR(S) : A. Preston Bailey and Lawrence J. Sullivan

It is certified that error appears in the above-identified patent and that said Letters Patent are hereby corrected as shown below:

Column 4, line 64, substitute --value-- for "valve".

Claim 8, column 7, line 20, after "through" insert --said--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*